United States Patent [19]

Anders

[11] 3,939,789

[45] Feb. 24, 1976

[54] DOUBLE-ACTING PNEUMATIC SYSTEM FOR INDUCING MOTION IN A FLOATING VESSEL

[75] Inventor: Edward O. Anders, Houston, Tex.

[73] Assignee: Global Marine, Inc., Los Angeles, Calif.

[22] Filed: Mar. 14, 1974

[21] Appl. No.: 450,994

Related U.S. Application Data

[63] Continuation-in-part of Ser. No. 183,466, Sept. 24, 1971, Pat. No. 3,850,125.

[52] U.S. Cl. ..... 114/40; 114/125

[51] Int. Cl.[2] ..... B63B 43/06

[58] Field of Search ..... 114/40, 41, 42, 121, 125

[56] References Cited

UNITED STATES PATENTS

| | | | |
|---|---|---|---|
| 968,927 | 8/1910 | Frahm | 114/125 |
| 2,995,103 | 8/1961 | Waas et al. | 114/40 |
| 3,133,519 | 5/1964 | Deane | 114/125 |
| 3,689,953 | 9/1972 | Markakis | 114/125 |
| 3,886,886 | 6/1975 | Anders | 114/125 |

*Primary Examiner*—Trygve M. Blix
*Assistant Examiner*—Charles E. Frankfort
*Attorney, Agent, or Firm*—Christie, Parker & Hale

[57] ABSTRACT

An improved vessel for use in ice-covered waters has a motion inducing tank disposed in its hull at a location spaced from the even-keel center of buoyancy of the hull. Ports communicate from the lower extent of the hull to the exterior of the hull below the hull load waterline for flow of water into and out of the tank in response to pressure in the tank being different from ambient pressure outside the hull. The tank extends vertically in the hull from a lower end located below the hull load waterline to an upper end located above the waterline substantially as far as the location of the ports below the load waterline. Airflow devices are coupled to the upper extent of the tank and are operable alternately for generating superatmospheric and subatmospheric air pressure in the tank. The airflow devices include an air pressurizing device having a suction connection and a discharge connection. Ducts are provided for coupling the suction connection separately to the upper extent of the tank and to atmosphere, and also for coupling discharge connections separately to the upper extent of the tank and to atmosphere.

4 Claims, 4 Drawing Figures

DOUBLE-ACTING PNEUMATIC SYSTEM FOR INDUCING MOTION IN A FLOATING VESSEL

CROSS REFERENCE TO RELATED APPLICATION

This application is a continuation-in-part of my copending application Ser. No. 183,466 filed Sept. 24, 1971, now U.S. Pat. No. 3,850,125.

FIELD OF THE INVENTION

This invention pertains to icebreakers. More particularly, it pertains to a double-acting pneumatic mechanism for shifting the center of buoyancy of a floating icebreaker back and forth along the length of the vessel to induce high amplitude, low frequency movements of the bow.

BACKGROUND OF THE INVENTION

My copending application describes an improved icebreaking vessel in which pitching motions are induced in the vessel at high amplitude and low frequency. These induced motions create considerable vertical momentum in the bow of the vessel. This momentum is applied to ice ahead of the vessel as the vessel moves along a desired path through ice-covered waters. The vessel breaks ice principally by reliance upon the vertical momentum of the bow, rather than by reliance upon the forward momentum of the vessel, although both forms of momentum cooperate to break ice as the vessel moves under power along its desired path.

The mechanism used to induce these pitching motions are pneumatic mechanisms in which air is applied to the upper extent of suitable pitching tanks to force water from the tanks through large openings through the hull at the lower ends of the tanks; to flood the tanks, the tanks are vented to atmosphere, in the usual case. This alternate flooding and emptying of the pitching tanks produces a fore-and-aft shift in the vessel center of buoyancy, relative to the fixed center of gravity of the vessel, to induce the desired high amplitude, low frequency pitching motions. Thus, the desired motions of the vessel are induced by manipulation of the vessel center of buoyancy relative to the stationary center of gravity of the vessel.

The location of a vessel's center of buoyancy is the centroid of volume of the water displaced by the submerged portions of the hull; the total volume of water displaced by the hull has a weight equal to the weight of the vessel and its contents. The location of the vessel center of gravity is defined by how steel and the like is distributed throughout the vessel during its construction, and how the contents of the vessel are distributed within the vessel. It is apparent that the location of the center of buoyancy is determined by the geometry, i.e., volume distribution, of the submerged portions of the hull. The copending application, therefore, describes pitching tanks which are located wholly below the even-keel load waterline of the vessel; that is, in the copending application, the pitching tanks are located essentially entirely in the submerged volume of the vessel because the tanks are used to manipulate the vessel's center of buoyancy, and buoyancy is a function of submerged volume. Similarly, in other buoyancy shifting systems provided for vessel motion stabilization and the like, such as U.S. Pat. No. 3,689,953, the buoyancy regulation chambers are located wholly below the vessel's even-keel load waterline.

Where a fully submerged chamber is used to regulate the position of a vessel's center of buoyancy, the tank is inherently single-acting in that it can, by flooding or emptying thereof, operate to shift the center of buoyancy back and forth on one side of the normal even-keel position of the center. For example, a normally-empty pitching tank located forwardly of the vessel's normal center of buoyancy and below the even-keel load waterline, when alternately flooded and emptied, is effective to move the center of buoyancy aft of its normal position when the tank is flooded and to move the center to its normal (even-keel) position when the tank is emptied. Thus, a normally-empty bow pitching tank is operable to cause the bow to pitch downwardly from its usual (even-keel) position. Pitching of the bow upwardly from its usual position requires the use of a normally-empty fully submerged pitching tank near the stern of the vessel.

According to the copending application, high amplitude, low frequency pitching motions of the bow of the vessel are desired during icebreaking. The greater the amplitude of bow motion, the greater the momentum of the bow as it moves upwardly or downwardly through its even-keel position; the greater the vertical momentum of the bow, the thicker the ice which can be broken and, usually, the greater the amount, in area, of ice broken. The copending application describes vessels having double-acting bows, i.e., bows which apply vertical bow momentum to break ice during both upstrokes and downstrokes of the bow. In view of these circumstances, the copending application describes vessels having both bow and stern pitching tanks which are operated out of phase with each other to produce both upward and downward excursions of the bow from its normal position, thereby producing high overall amplitudes of pitching motion to generate large amounts of vertical momentum in the bow.

Where an induced pitching icebreaker has a bow of conventional single-acting configuration, best performance of the vessel in ice is obtained where the induced motions of the bow are upwardly from the normal position of the bow.

Preferably the pitching tanks are of the normally-empty type. That is, during operation of the vessel in ice-free waters, the tanks are empty and their discharge ports are closed for maximum statical stability and maximum propulsive efficiency of the vessel.

These factors are at odds with the fact that, for greatest volumetric efficiency, a stern pitching tank should be located as far aft in the vessel as possible, and the fact that in most vessels, space, especially pitching tank space, is not readily available in the stern portion. Usually, there is considerably more space available near the bow for a pitching tank of given volume than near the stern.

It will be seen that a need exists, in the context of induced motion vessels for icebreaking and the like, for a double-acting motion inducing arrangement which can be located away from the stern of the vessel and which can be operated to produce vessel motions in both directions from the even-keel position of the vessel.

SUMMARY OF THE INVENTION

This invention provides simple, economic and reliable apparatus which satisfies the above-identified need. The present double-acting, pneumatically-activated motion inducing mechanism may be located in the forward portion of the vessel and is operable to induce motions of the bow both upwardly and downwardly from normal even-keel position of the bow. The present mechanism requires less energy to operate it than is required to operate single-acting bow and stern motion inducing tanks of equivalent volume.

Generally speaking, this invention provides an improved vessel in use in ice covered waters. The vessel includes a hull. A motion inducing tank is disposed in the hull at a location spaced from its even-keel center of buoyancy. Port means communicate from the lower extent of the tank to the exterior of the hull below the load waterline, for flow of water into and out of the tank in response to the pressure in the tank being different from ambient pressure outside the hull. The tank extends vertically in the hull from a lower end located below the hull load waterline to an upper end which is located above the load waterline substantially as far as the location of the port means below the load waterline. Airflow means are coupled to the upper extent of the tank and are operable alternately for generating super-atmospheric and subatmospheric air pressure in the tank. The airflow means include an air pressurizing device which has a suction connection and a discharge connection. Duct means couple the suction connection separately to the upper extent of the tank and to atmosphere and couple the discharge connection separately to the upper extent of the tank and to atmosphere.

The present invention, which pertains to a buoyancy shifting motion inducing mechanism, is to be distinguished from the technology pertaining to mass-transfer motion inhibiting systems for floating vessels, such as are used to stabilize a vessel from wave-induced pitching and rolling motions. Some prior patents pertaining to mass-transfer motion stabilization systems, such as U.S. Pat. No. 2,066,150, are only superficially relevant in terms of structure and procedure to the subject matter of the present invention. Structural arrangements and mechanisms for mass-transfer motion stabilization systems require that the vessel be subjected to some motion from an external source in order that they may be operative to stabilize such motions. When a vessel operates in waters covered by an ice sheet, the ice itself prevents the presence of waves, such that mass-transfer motion stabilization systems dependent upon wave-induced vessel motion will not function.

DESCRIPTION OF THE DRAWINGS

The above-mentioned and other features of this invention are more fully set forth in the following detailed description of the presently preferred embodiment of this invention, which description is presented with reference to the accompanying drawings, wherein.

DESCRIPTION OF THE ILLUSTRATED EMBODIMENTS

Figure 1:
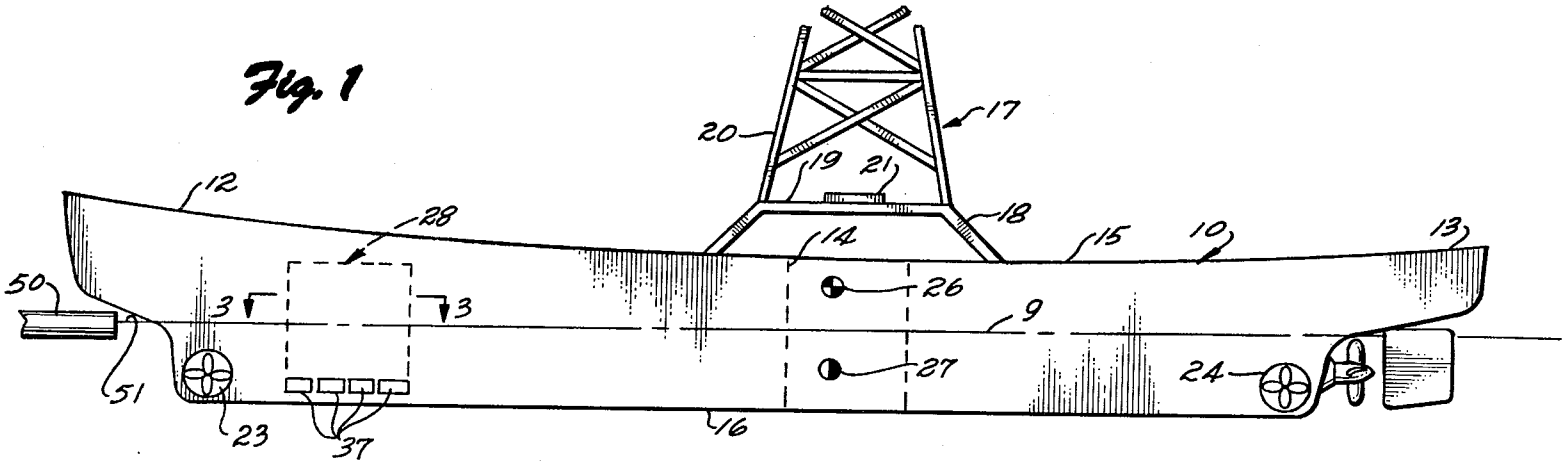
FIG. 1 is an elevation view of an icebreaking drillship equipped with a double-acting buoyancy transferring mechanism.

The present invention is described in the context of a self-pitching, i.e., induced pitching, icebreaking drillship 10, as shown in FIG. 1. An icebreaking drillship constitutes the presently preferred environment of this invention, but it will be appreciated that the double-acting pneumatically operated motion inducing mechanism described herein may be used in other types of vessels intended for use in ice covered waters, such as icebreakers per se, tankers, freighters, and work boats used for logistical support of drillships and the like.

Drillship 10 has a positively buoyant hull 11 which is shown floating in its icebreaking even-keel position at load waterline 9. The hull has an icebreaking bow portion 12 and a stern portion 13. The hull also defines a centerwell 14 through the hull from main deck 15 to keel 16 at about amidships. The centerwell preferably is centered on the longitudinal center plane 22 (see FIG. 3) of the vessel below a drilling rig 17 supported on the main deck of the vessel. The drilling rig includes a foundation structure 18 which defines a drilling platform 19 over which a conventional derrick structure 20 is mounted. A conventional rotary table 21 is mounted in the drilling platform over the centerwell. The drilling rig preferably also includes conventional draw works and associated equipment (not shown). To facilitate transit of the vessel, through ice covered waters, and also to facilitate station-keeping of the vessel over a desired well site during drilling operation, the hull includes fore-and-aft athwartship reversible thruster mechanisms 23 and 24 in the bow and stern portion of the hull, respectively, for generating thrust to port or to starboard of the hull as desired.

Vessel 10 has a center of gravity 26 located approximately amidships above a center of buoyancy 27 when the hull has an untrimmed icebreaking even-keel attitude as shown in FIG. 1. A double-acting buoyancy modulating pitching mechanism 28 is located in the hull in bow portion 12 for shifting center of buoyancy 27 in a fore-and-aft direction at a selectable frequency. As described more fully below, the pitch inducing mechanism is pneumatically operated and is operative to accomplish the shift in buoyancy without significantly altering the displacement, i.e., total weight of vessel 10 or the location of center of gravity 26. The selectable frequency associated with operation of the pitch inducing mechanism typically is a frequency within a range of frequencies each of which has a period of several seconds. The pitching motions induced in the vessel, as measured at the bow, have an amplitude of at least a foot and preferably are on the order of 4 to 5 feet or more depending upon the overall dimensions of the vessel, the volumetric capacity of the motion inducing mechanism, and the character of ice which it is expected that the vessel will encounter during its useful life.

Figure 3:
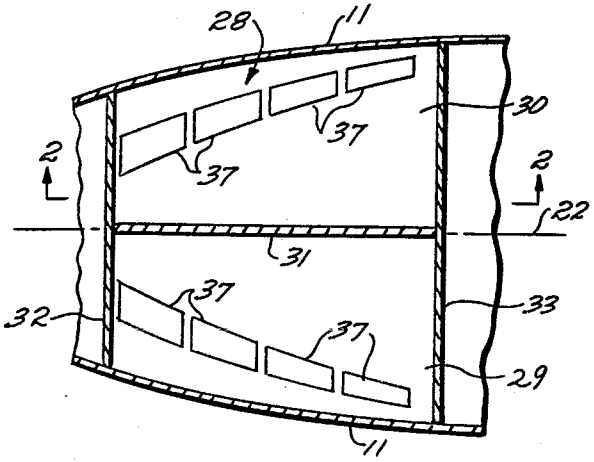
FIG. 3 is an enlarged plan view taken along line 3—3 in FIG. 1.

As shown best in FIG. 3, pitch inducing mechanism 28 preferably includes essentially identical port and starboard pitching tanks 29 and 30, respectively, disposed symmetrically on opposite sides of a dividing bulkhead 31 disposed on the longitudinal center plane 22 of the vessel. The forward and rear walls of the tanks are defined by tranverse bulkheads 32 and 33 while the outer, i.e., outboard, walls of the tanks are defined by respective portions of the shell of hull 11. The lower extent of the tanks conveniently may be defined by the innerbottom 34 of the vessel. Each tank has an upper wall 36 disposed substantially horizontally in the vessel above load waterline 9 but below main deck 15. Except for the water flow ports and airflow duct openings to them, the pitching tanks are airtight. Inasmuch as pitching tanks 29 and 30, and the airflow means for these two tanks, are essentially identical, a description of starboard pitching tank 30 and its airflow means 35 will suffice as a description for both tanks.

Figure 2:
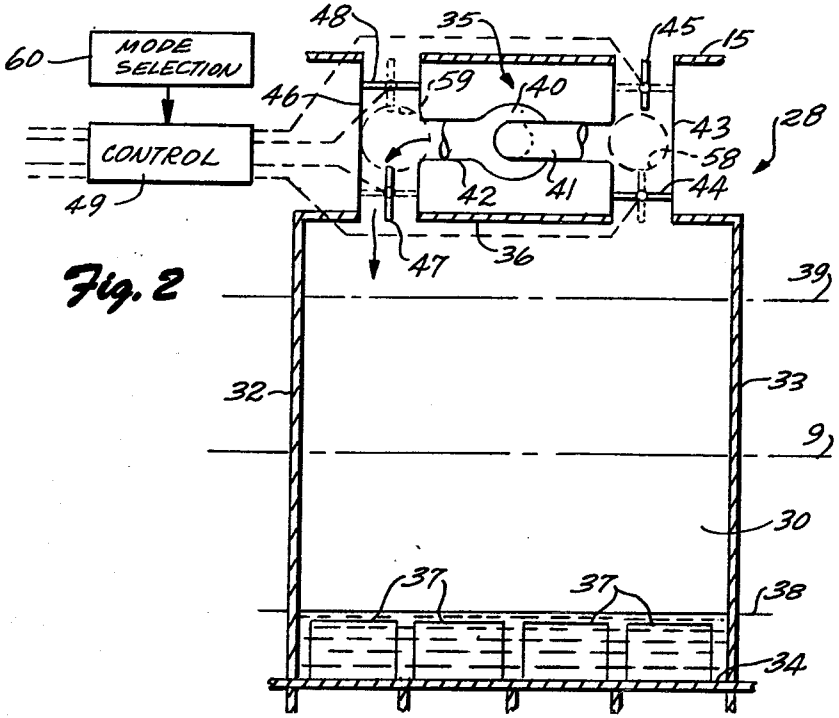
FIG. 2 is an enlarged cross-sectional elevation view of the double-acting motion inducing mechanism.

As shown best in FIG. 2, which is an elevation view taken along line 2—2 in FIG. 3 of starboard pitching tank 30, pitching tank 30 extends vertically above and below hull load waterline 9. As noted above, load waterline 9 is the waterline at which the vessel floats in an even-keel attitude during icebreaking, as shown in FIG. 1. A plurality of ports 37 are formed through hull 11 adjacent the lower end of tank 30 to provide communication between the tank space and the exterior of the vessel below waterline 9. The aggregate area of ports 37 is large relative to the volume of tank 30 so that water may flow into and out of the tank from the exterior of the vessel without any significant restrictions of such nature as to cause the water in the tank to be held captive within the tank as the vessel experiences induced pitching motions. That is, the effective water-flow area of ports 37 is sufficiently large that water flows freely through the ports in response to the difference between the pressure within tank 30 and ambient pressure outside the hull. Preferably ports 37 are defined in the hull at a level below a level 38 which corresponds to the lowest level of water in tank 30 in response to the application of air at super-atmospheric pressure to the tank from airflow means 35. The upper wall of tank 30 is disposed above a level 39 located above waterline 9. Water level 39 corresponds to the uppermost level of water in tank 30 in response to the generation of subatmospheric pressure within the tank by airflow means 35. Preferably, low water level 38 and high water level 39 of tank 30 are approximately equidistantly spaced on opposite sides of waterline 9.

Airflow means 35 includes an air pressurizing device 40 of the continuously operating type, such as a squirrel cage blower or axial flow compressor. The air pressurizing device is a high volume, low pressure device and has a suction connection 41 and a discharge connection 42. Ducting 43 couples suction connection 41 to the upper extent of tank 30 via an airflow regulating valve 44 and separately to atmosphere, as through main deck 15, via a regulating valve 45. Similar ducting 46 couples the discharge connection of air pressurizing device 40 to the upper extent of tank 30 via regulating valve 47 and separately to atmosphere, as through main deck 15, via regulating valve 48. Regulating valves 44, 45, 47, and 48 are operated by a control mechanism 49 and are suitably coupled to the control mechanism as illustrated in broken lines in FIG. 2.

Where tanks 29 and 30 are to be operated only for inducing pitching motions in vessel 10, airflow means 35 may be common to both of the pitching tanks. Such an instance centerline bulkhead 31 may be deleted so that only a single pitching tank is provided in the vessel on centerplane 22; if provided, bulkhead 31 may be perforated so as to serve only as a stability enhancing swash plate for damping movement of water in the tank from side to side of the vessel. On the other hand, where it is desired to operate tanks 29 and 30 out of phase with each other for generating rolling motions of the vessel, in addition to pitching motions, each of tanks 29 and 30 is equipped with its own airflow means, the two airflow means being essentially identical.

During operation of vessel 10 in open waters, i.e., waters not covered by ice, in which induced pitching mechanism 28 is not used, ports 37 from tanks 29 and 30 are covered by suitable doors or covers, not shown, which are removably affixed to the hull in any suitable manner. Preferably, when ports 37 are closed by the removable doors, tanks 29 and 30 are dry, i.e., contain no water. In such a case the vessel has an open water even-keel position in which bow portion 12 rides somewhat higher out of the water than in the icebreaking even-keel position of the vessel as shown in FIG. 1.

During operation of induced pitching mechanism 28 to induce pitching motions in vessel 10, valves 44 and 48 are operated in tandem by control mechanism 49, and valves 45 and 47 are also operated in tandem out of phase with valves 44 and 48 as determined by control mechanism 49.

Assume that vessel 10 has encountered ice either during movement of the vessel along an intended route or while station-keeping during drilling operations. Ports 37 are opened by removing the closure doors so that water floods the tanks to water level 9. Air pressurizing device 40 is activated and desired pitching motions of the vessel are induced at the appropriate frequency by cycling valves 44 and 48, on the one hand, and valves 45 and 47, on the other hand, between their open and closed positions. When valves 44 and 48 are closed, as shown in the solid lines in FIG. 2, the discharge, i.e., superatmospheric connection, of air pressurizing device 40 is connected to the upper extent of tank 30 via valve 47 and the suction, i.e., subatmospheric connection, of the air pressurizing device is connected to atmosphere via valve 45. (At this time, valves 44 and 48 are closed as shown in FIG. 2.) The application of air at superatmospheric pressure to tank 30 results in water being driven out of the tank until the pressure of water in the tank inside the tank adjacent ports 37 is equal to the hydrostatic pressure of water outside the vessel adjacent the ports. If the discharge pressure of device 40 is on the order of two pounds per square inch, lower water level 38 within tank 30 will be approximately 4 ½ feet below icebreaking load waterline 9. Such out-flow of water from tank 30, and concurrently from tank 29, is effective to increase the buoyancy of vessel 10 in its bow portion such that the center of buoyancy of the vessel shifts forwardly along the length of the vessel from below center of gravity 26, thereby resulting in the application to the vessel of a moment which tends to raise the bow of the vessel.

Once the water level in tanks 29 and 30 has been lowered to low water level 38, and bow 12 has raised or begun to raise above its icebreaking even-keel position, the operative positions of valves 44, 45, 47 and 48 are reversed (as shown in broken lines in FIG. 2) so that valves 44 and 48 are open and valves 45 and 47 are closed. In this condition of the air regulating valves, the suction connection of the air pressurizing device is coupled to the upper extent of the tank via valve 44 and the discharge connection of the air pressurizing means is connected to atmosphere via valve 48. Accordingly, subatmospheric pressure is generated in the upper extent of the tank so as to allow water to flood into the tank through ports 37. The height of level 39 above icebreaking load waterline 9 is determined by the amount by which the subatmospheric pressure generated by air pressurizing device 40 is less than atmospheric pressure. If the discharge pressure of the airflow means is approximately two pounds per square inch greater than atmospheric pressure, the subatmospheric pressure generated in the tank will be on the order of about two pounds per square inch less than atmospheric pressure. Thus, high water level 39 within tanks 29 and 30 is on the order of 4 ½ feet above icebreaking waterline 9. When water is present in the pitching tanks to level 39, the effective buoyancy in the bow portion of the vessel is reduced below the effective buoyancy corresponding to the icebreaking load waterline on the vessel, such that the center of buoyancy for the vessel as a whole shifts rearwardly of center of gravity 26. A moment is thus applied to the vessel which induces the bow portion 12 to move downwardly toward an ice sheet 50 floating on water surface 51 ahead of the vessel. As shown in FIG. 1, bow portion 12 has an ice breaking configuration so that the downward momentum of the bow is effectively applied to the upper surface of the ice sheet to break the ice in front of the vessel.

The valves of airflow means 35 are again operated to apply superatmospheric pressure to tank 30 (and also to tank 29) at a time when the bow is below its icebreaking even-keel position, thereby to again induce the bow to pitch upwardly to and above its even-keel position.

The icebreaking bow configuration shown in FIG. 1 is a conventional single-acting downwardly effective bow. It will be apparent, however, especially in view of the patent issued on my copending application, that the bow design of vessel 10 may have a double-acting configuration, if desired.

Figure 4:
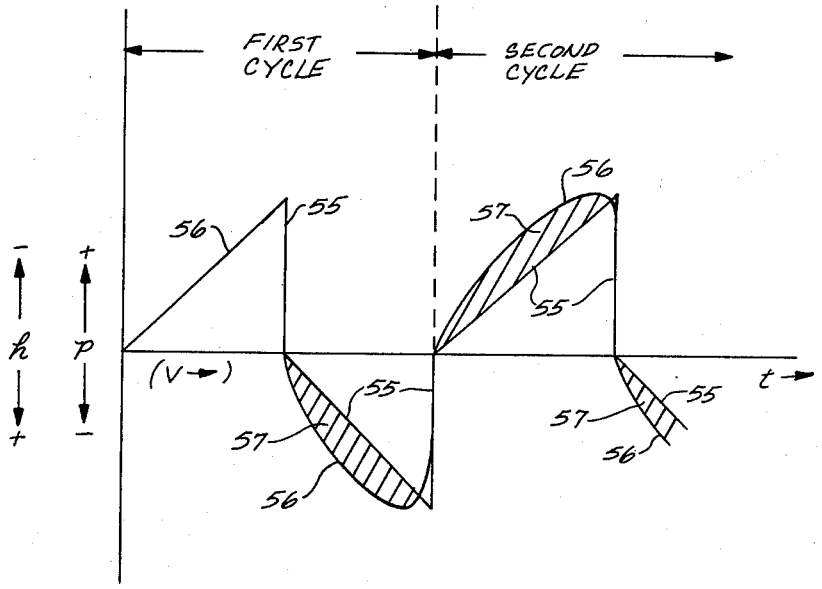
FIG. 4 is a graphical representation in which the air pressure and water height in the double-acting motion inducing tank are plotted against time to illustrate certain features of this invention.

From the foregoing description concerning FIG. 2, it is apparent that pitch inducing mechanism 28 is effective to change the water level in the pitching tanks to level 38, below the icebreaking load waterline of the vessel, and to water level 39 above the icebreaking load waterline of the vessel. In comparison to the pitching tanks described in my copending application which are located below the load waterline of the vessel, pitching mechanism 28 is a double-acting pitch inducing mechanism effective to produce movements of the vessel bow above and below the normal position of the bow during icebreaking operations. As shown in FIG. 4, the double-acting pitch inducing arrangement shown in FIG. 2 is more effective, in terms of the horsepower required to operate the same, than is obtained by distributing the volume of tanks 29 and 30 between single-acting pitch inducing tanks located in the bow and the stern of the vessel, respectively.

FIG. 4 is a graphic representation of the variations in air pressure $p$ and water level $h$ in tank 30, for example, as a function of time. Thus in FIG. 4, line 55 represents the variation of pressure $p$ with time in tank 30, positive pressure being plotted above the time axis and negative pressure being plotted below the time axis. Variations in water level $h$ by line 56 relative to the icebreaking load waterline of the vessel are plotted vertically against time, water levels below the icebreaking load waterline being plotted above the time axis and water levels above the load waterline being plotted below the time axis. From an inspection of FIG. 4, therefore, it will be apparent that the pressure and water level lines 55 and 56 coincide with each other during the first application of positive pressure to water in tank 30 through the first half cycle of the operation of pitch inducing mechanism, which operation corresponds to the first half cycle of pitching motion of the vessel. FIG. 4 further illustrates that during the second half of the first cycle of the operation of the pitch inducing mechanism, as well as through remaining cycles of the mechanisms, the pressure and water level lines are not coincident, the difference between these lines represented by the shaded areas 57 in FIG. 4. The amount of shaded area in FIG. 4 between lines 55 and 56 represents work done upon the mechanism in a manner additive to the energy required to operate the air pressurizing device 40. Stated in another way, the areas 57 in FIG. 4 represent stored or potential energy in the pitch inducing mechanism. To the extent that stored energy is present in the operation of the pitch inducing mechanism, less power is required to drive the airflow means for the same net effect of the vessel upon the ice. Specifically, as the valves of airflow means 35 are shifted from their solid line positions to their broken line positions, as shown in FIG. 2, the water level in tank 30 corresponds to low water level 38. As the valves of the airflow means are shifted to connect the suction connection of the pressurizing device to tank 30, the air pressure in the tank drops substantially instantaneously to atmospheric pressure. In the interval immediately following coupling of the suction connection of the air pressurizing device to the tank, the hydrostatic pressure outside of the tank is substantially greater (by an amount corresponding to the difference in elevation between load waterline 9 and low water level 38) than pressure within the tank. Thus, water floods rapidly into the tank through ports 37 so as to assist the airflow means in reducing the pressure within the pitching tank. This circumstance is illustrated by the deviation between pressure and water level curves 55 and 56, respectively, during the second half of the first cycle of operation of the pitch inducing mechanism. In other words, the momentum of water flowing into the tank, in conjunction with the concurrent downward movement of the bow, causes water to rise in the tank of its own accord above icebreaking load waterline 9, such that less energy is required to raise water in the tank to high water level 39 than if only evacuation of air from the tank were relied upon. It will be seen from FIG. 4 that as the vessel continues its pitching motion into and through the second and succeeding cycles of operation of the pitch inducing mechanism, the same energy conserving effect occurs during both the upstroke and the downstroke of the bow.

It is thus apparent that, for given volumetric capacity of a double-acting pitch inducing tank located in the bow of vessel 10, the double-acting tank is more efficient, in terms of energy required to induce pitching motion of the vessel, than if the volume of the double-acting tank were distributed between two single-acting tanks located in the bow and stern portions of the vessel, respectively.

In the case where pitch inducing mechanism is composed of a pair of separate tanks 29 and 30 located on opposite sides of the longitudinal center plane of the vessel, and each tank is equipped with its own airflow means, a common control mechanism 49 is provided for the two airflow means. This circumstance is illustrated in FIG. 2. Also, in this circumstance, i.e., that of two pitching tanks with their own airflow means, the tanks can be operated 180° out of phase with each other to produce pure rolling motion of the vessel, if desired. Also, two port and starboard pitch inducing tanks may be operated out of phase with each other, but at something other than a 180° phase differential, to produce composite pitching and rolling, i.e., wallowing of the vessel as is sometimes desired in icebreaking depending upon the character of the ice encountered by the vessel. To impart maximum flexibility and versitility to the motion inducing apparatus included in the vessel, ducting 43 of one pitching tank may be cross-connected, as by cross-connection duct 58, to ducting 46 of the airflow means for the other tank, and vice versa as by a second cross-connection duct 59. In this manner, especially where port and starboard motion inducing tanks are present with their own airflow means, the suction connection of one airflow means may be coupled to the discharge connection of the other airflow means, via appropriate valving in the cross-connection ducts, for best usage of available power during induced rolling of the vessel. During induced rolling of the vessel, control mechanism 49 may be relied upon to operate the valves of the respective airflow means in a somewhat different manner than during pure pitching motions, the different modes of control exercised by the control mechanism upon the valves being determined by the state of a mode selection device 60 coupled to the control mechanism.

The invention has been described above by reference to presently preferred apparatus in the context of a presently preferred environment or application of the invention. Workers skilled in the art and technology to which this invention pertains will grasp readily the principal teachings presented herein and will appreciate that variations of the illustrated apparatus and procedures can be used to advantage in other applications without departing from these teachings. For this reason, the foregoing description is illustrative rather than exhaustive of the many forms and structural embodiments which this invention may take, and the preceding description should not be considered as limiting the scope of this invention.

What is claimed is:

1. An improved vessel for use in ice-covered waters comprising a hull, a motion inducing tank disposed in the hull at a location spaced from the hull even-keel center of buoyancy, port means for communicating the lower extent of the tank to the exterior of the hull below the load waterline for flow of water into and out of the tank in response to pressure in the tank being different from ambient pressure outside the hull, the tank extending vertically in the hull from a lower end located below the hull load waterline to an upper end located above said waterline substantially as far as the location of said port means below said waterline, and air flow means coupled to the upper extent of the tank and operable alternately for generating superatmospheric and subatmospheric air pressure in the tank, the airflow means including an air pressurizing device having a suction connection and a discharge connection, duct means for coupling the suction connection separately to the upper extent of the tank and to atmosphere and for coupling the discharge connection separately to the upper extent of the tank and to atmosphere, and valve means in the duct means operable between a. a first state in which
   1. the suction connection is coupled to the tank and
   2. the discharge connection is coupled to atmosphere thereby to generate subatmospheric pressure in the tank, and
b. a second state in which
   1. the suction connection is coupled to atmosphere and
   2. the discharge connection is coupled to the tank thereby to generate superatmospheric pressure in the tank.

2. A vessel according to claim 1 wherein the tank is located in the hull at a location spaced forwardly along the length of the vessel from said center of buoyancy.

3. A vessel according to claim 1 wherein the tank is located in the hull at a location spaced along the beam of the vessel from said center of buoyancy.

4. An improved vessel for use in ice-covered waters comprising a hull, a pair of motion inducing tanks disposed in the hull at a location spaced forward from the hull even-keel center of buoyancy on opposite sides of the hull longitudinal center plane, port means for communicating the lower extent of each tank to the exterior of the hull below the load waterline for flow of water into and out of the tank in response to pressure in the tank being different from ambient pressure outside the hull, each tank extending vertically in the hull from a lower end located below the hull load waterline to an upper end located above said waterline substantially as far as the location of said port means below said waterline, separate airflow means for each tank coupled to the upper extent of the tank and operable alternately for generating superatmospheric and subatmospheric air pressure in the tank, each airflow means including an air pressurizing device having a suction connection and a discharge connection, means for coupling the suction connection of each airflow means separately to the upper extent of the respective tank and to atmosphere and for coupling the discharge connection of each airflow means separately to the upper extent of the respective tank and to atmosphere, and control means for operating the airflow means for the tanks in phase for inducing pitching of the vessel and for operating the airflow means for the tanks out of phase with each other for inducing rolling of the vessel.

* * * * *